US005121714A

United States Patent [19]

Susa et al.

[11] Patent Number: 5,121,714

[45] Date of Patent: Jun. 16, 1992

[54] COOLING OF AN INTERNAL-COMBUSTION ENGINE

[75] Inventors: Sumio Susa, Anjo; Sunao Fukuda, Handa; Kazutaka Suzuki, Kariya, all of Japan

[73] Assignee: Nippondenso Co., Ltd., Kariya, Japan

[21] Appl. No.: 654,094

[22] Filed: Feb. 13, 1991

[30] Foreign Application Priority Data

Feb. 16, 1990 [JP] Japan ..... 2-36920

[51] Int. Cl.[5] ..... F01P 7/14

[52] U.S. Cl. ..... 123/411; 123/41.29

[58] Field of Search ..... 123/41.02, 41.08, 41.09, 123/41.10, 41.29, 196 AB

[56] References Cited

U.S. PATENT DOCUMENTS 3,211,374 10/1965 Matulaitis ..... 237/8
4,319,547 3/1982 Bierling ..... 123/41.29
4,369,738 1/1983 Hirayama ..... 123/41.1
4,381,736 5/1983 Hirayama ..... 123/41.1

FOREIGN PATENT DOCUMENTS 0038556 10/1981 European Pat. Off. .
2436878 4/1980 France .
59-28016 2/1984 Japan .
63-289213 11/1989 Japan .

*Primary Examiner*—Noah P. Kamen
*Attorney, Agent, or Firm*—Cushman, Darby & Cushman

[57] ABSTRACT

In order to cool an engine effectively, an engine oil temperature is detected by an oil temperature sensor. When the engine oil temperature is above a predetermined valve, the cooling fluid being introduced into the engine is divided into two streams. One stream is introduced into a cylinder head and the other stream is introduced into a cylinder block. The amount of cooling fluid being introduced into the cylinder block is controlled according to the engine oil temperature.

4 Claims, 5 Drawing Sheets

COOLING OF AN INTERNAL-COMBUSTION ENGINE

BACKGROUND OF THE INVENTION

1. Field of the Invention

The present invention relates to a method of cooling an internal-combustion engine and a cooling device thereof. The internal-combustion engine is especially for an automobile.

2. Description of the Related Art

FIG. 10 shows a conventional cooling device where an engine 301 and a radiator 302 are connected with each other by conduits 304 through which a cooling fluid for cooling the engine 301 flows. The cooling fluid receives a flowing force from a waterpump 303. A bypass conduit 305 is connected to the conduits 304 at both an inlet portion and an outlet portion of the radiator 302. When the temperature of cooling fluid flowing out from the radiator 302 is above a predetermined value, the cooling fluid flows in the bypass conduit 305 to bypass the radiator 302. When the temperature of the same is below the predetermined value, a thermostat valve 306 closes the bypass conduit 305 so that the cooling fluid flows into the radiator 302 to be cooled. A heater core 308 is provided in the conduit 304.

In order to cool the engine 301 efficiently, it is required that the cooling efficiency of the cooling device be controlled according to the condition of the engine 301, which varies frequently. The water-pump 303 is driven by the engine 301 and the discharge capacity of water-pump 303 is determined to prevent cavitation of the water-pump 303 and to circulate enough water so that even if the engine 301 is placed under the worst of conditions, such as the automobile going up a slop at a low speed.

Recently, the power of an engine has been increasing and the amount of heat transmitted from the engine to the cooling fluid is also increasing. Therefore, the radiator and the cooling fan are required to be large enough to radiate the heat efficiently. However, the space of an engine room tends to be smaller than ever thereby making it harder to meet such a requirement. One idea to radiate the heat efficiently is to make the discharge capacity of the water-pump larger. However, each increment of the discharge capacity of a water-pump causes an increment of the heat loss of the engine, so that the radiator 302 and the cooling fan 307 become large. When the amount of cooling fluid is increased, the warming up characteristic of the engine becomes worse.

Japanese unexamined patent publication (kokai) 59-28016 shows a cooling device wherein cooling fluid is introduced into a cylinder head and a cylinder block independently. Two streams of the cooling fluid are merged in the cylinder head. The amount of cooling fluid introduced into the engine is controlled by a control valve. However, since a water-pump is driven by the engine, the amount of cooling fluid discharged from the water-pump varies according to the engine rotation, so that enough cooling fluid is not always supplied to the engine. The amount of cooling fluid is determined according to an intake vacuum pressure, a velocity of an automobile and a cooling fluid temperature. The cooling fluid temperature varies especially, according to the course of the cooling fluid and the cooling capacity of the radiator. Namely, the cooling fluid temperature does not always represent a realistic condition of the engine.

SUMMARY OF THE INVENTION

An object of the present invention is to cool an engine efficiently even when the engine condition is varied rapidly, the cubic capacity of the engine becomes large, and the power of the engine becomes high.

To achieve the object described above, the temperature of the cooling fluid or the engine is detected and the rate of cooling fluid is controlled independently of the engine rotation when the temperature is above predetermined valve. When the temperature of the engine oil is above a predetermined value, a stream of cooling fluid is divided into two streams, one of which is introduced into the engine block and the other is introduced into the engine cylinder.

The cooling device of the present invention has a first inlet conduit which introduces cooling fluid into the cylinder head and a second inlet conduit which is diverged from the first inlet conduit and introduces cooling fluid into the cylinder block. The amount or rate of cooling fluid flowing in the second inlet conduit is controlled by a flow control valve and the cooling fluid is circulated by a water-pump which is driven by the engine. A first temperature detector detects the temperature of the cooling fluid or the engine. When the temperature of the cooling fluid or the engine is above a predetermined value, a first control means controls a discharge volume of the water-pump independently from the engine rotation. A second temperature detector detects the temperature of engine oil. When the temperature of the engine oil is above a predetermined value, a second control means diverges the cooling fluid from the first inlet conduit into the second inlet conduit.

The amount of cooling fluid flowing in the cylinder block is controlled according to the engine oil temperature. The cooling fluid is circulated sufficiently to cool the engine.

While the invention has been described in connection in with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

DETAILED DESCRIPTION OF THE PRESENTLY PREFERRED EXEMPLARY EMBODIMENTS

Figure 1:
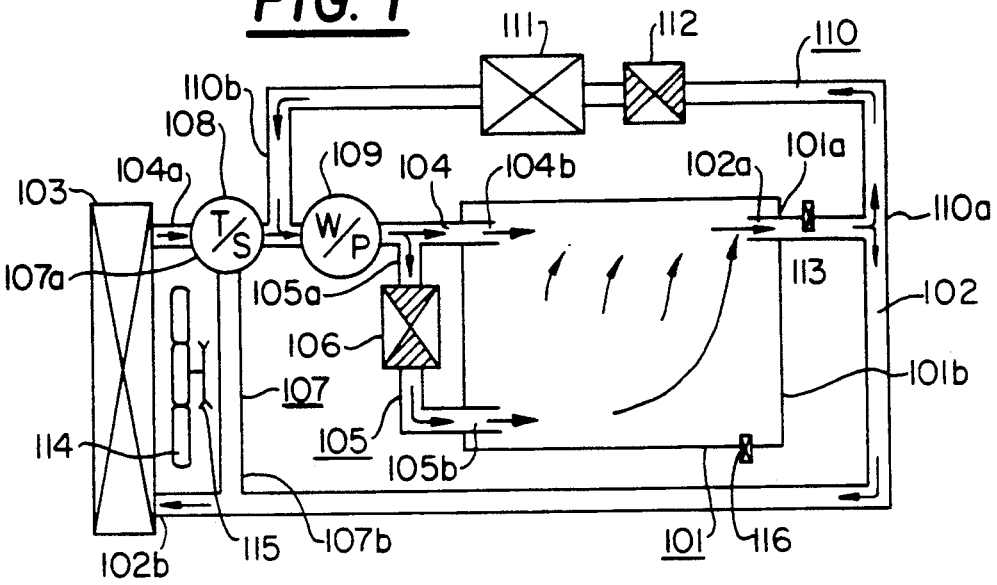
FIG. 1 is a schematic view of an embodiment of the present invention.

As shown in FIG. 1, an engine 101 for an automobile has a cylinder head 101*a* and a cylinder block 101*b* through which cooling fluid flows, respectively. A first end 102*a* of an outlet conduit 102 is connected to the cylinder head 101*a*. The cooling fluid that flows through the cylinder head 101*a* and the cylinder block 101*b* is introduced into the outlet conduit 102. A second end 102*b* of the outlet conduit 102 is connected to a radiator 103 which exchanges the heat of the cooling fluid with cooling air.

A first end 104*a* of a first outlet conduit 104 is connected to the radiator 103.

The cooling fluid cooled by the radiator 103 is discharged into the first inlet conduit 104. A second end 104*b* of the first inlet conduit 104 is connected to the cylinder head 101*a*. A first end 105*a* of a second inlet conduit 105 is connected to the first inlet conduit 104 and a second end 105*b* thereof is connected to the cylinder block 105*b*, so that the cooling fluid flows into the cylinder head 101*a* through the first inlet conduit 104 and into the cylinder block 101*b* through the second inlet conduit 105. A flow control valve 106 is provided on the second inlet conduit 105 to control the amount of cooling fluid flowing in the second inlet conduit 105. The flow control valve 106 can be actuated by an oil hydraulic, electrical, vacuum or a mechanical actuator.

A first end 107*a* of a radiator-bypass conduit 107 is connected to the first inlet conduit 104 upstream of the first end 105*a*. A second end 107*b* thereof is connected to the outlet conduit 102 at the side of the second end 102*b*. The cooling fluid flowing through the outlet conduit 102 can bypass the radiator 103 by flowing through the radiator-bypass conduit 107.

A thermostat valve 108 is provided at a connecting point of the radiator-bypass conduit 107 and the first inlet conduit 104. The thermostat valve 108 alternately opens or closes the radiator-bypass conduit 107. When the temperature of the cooling fluid flowing through the outlet conduit 102 toward the radiator-bypass conduit 107 is below a predetermined value (60° C.–80° C.), the thermostat valve 108 opens the bypass conduit 107, so that the cooling fluid bypasses the radiator 103. When the temperature of cooling fluid is above the predetermined valve, the thermostat valve 108 closes the bypass conduit 107, so that all of the cooling fluid flows into the radiator 103. The thermostat valve 108 can be replaced by an electrical-control valve.

A water-pump 109 is disposed on the first inlet conduit 104 between the thermostat valve 108 and the first end 105*a*. The water-pump 109 is driven by an oil hydraulic motor 304 (shown in FIG. 2), according to the rotational speed of the engine, and circulates the cooling fluid between the engine 101 and the radiator 103.

Figure 2:
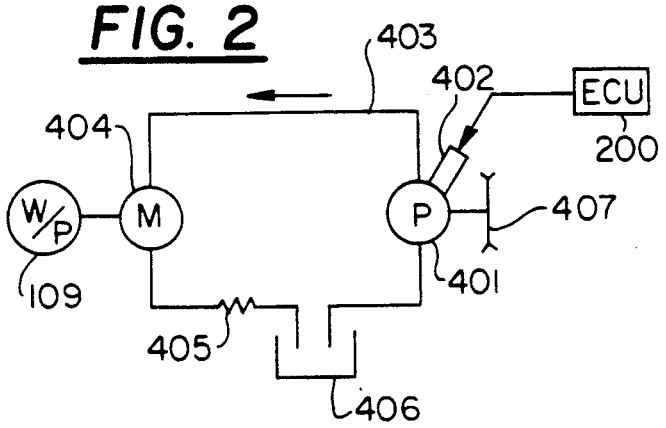
FIG. 2 is a schematic view of an oil hydraulic pump system of the present invention.

A hydraulic circuit for driving the water-pump 109 is shown in FIG. 2. An oil hydraulic pump 401 and an oil hydraulic motor 404 are connected with each other through a conduit 403. The oil hydraulic pump 401 is driven by the engine 101 through a clutch 407. A control valve 402 receives signals from an electronic control unit (ECU) 200 so as to control the discharge volume of the hydraulic pump 401. The working oil discharged from the oil hydraulic pump 401 flows through the conduit 403 and rotates the oil hydraulic motor 404. The oil hydraulic motor 404 thereby drives the water-pump 109. The working oil is cooled by an oil cooler 405 and then stored in a reservoir 406.

A first end 110*a* of a heater-conduit 110 is connected to the outlet conduit 102 and a second end 110*a* is connected to the inlet conduit 104 between the thermostat valve 108 and the water-pump 109. A heater 111 and a water-valve 112 are provided in the heater-conduit 110. The heater 111 warms air by exchanging heat with the cooling fluid. The water-valve 112 alternately opens or closes the heater-conduit 110. When the water-valve 112 opens the heater-conduit 110, the warmed cooling fluid flows through both the heater-conduit 110 and the outlet conduit 102.

A water temperature sensor 113 (a first temperature detector) is provided in the outlet conduit 102 upstream of the first end 110*a* to detect the temperature of the cooling fluid which flows out from the cylinder head 101*a*. An oil temperature sensor 116 (a second temperature detector) is provided on the engine 116 to detect the engine oil temperature.

A radiator-fan 114 is disposed downstream of the radiator 103 to intake air through the radiator 103. The radiator-fan 114 can be driven by an electrical motor 115 or an oil hydraulic motor.

Figure 3:
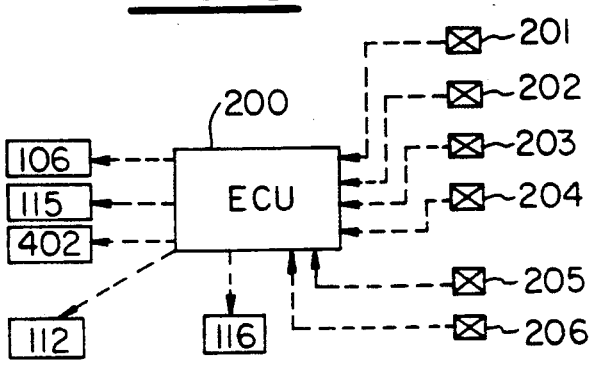
FIG. 3 is a circuit showing a connecting relation between an E.C.U. and a sensor according to the present invention.
Figure 4:
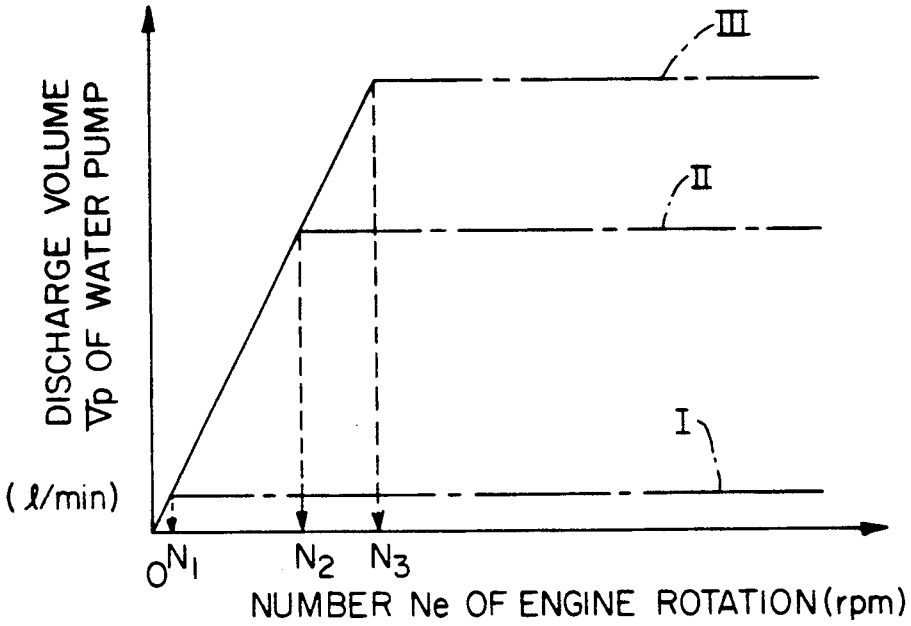
FIG. 4 is a diagram showing a relation between a number of engine rotation and a discharge volume of water-pump.

As shown in FIG. 3, the ECU 200 receives signals from an outside-air temperature sensor 201, and intake-air temperature sensor 202, a vacuum pressure sensor 203 which detects vacuum pressure in intake pipe of the engine 101, a velocity sensor 204 which detects the velocity of the automobile, an engine-rotation sensor 205 and the oil temperature sensor 116. The ECU 200 calculates the best operating condition of the cooling device and sends control signals to the flow control valve 106, the control valve 402, the water-valve 112 and the electric motor 115.

The operation of the cooling device of the present invention will now be described. When the engine 101 is started, the oil hydraulic pump 401 is driven so as to discharge the working oil toward the oil hydraulic motor 404. The oil hydraulic motor 404 rotates the water-pump 109. The water-pump 109 discharges the cooling fluid, some of which flows into the cylinder head 101*a* through the first inlet conduit 104 and the other of which flows into the cylinder block 101*b* through the second inlet conduit 105. The flow control valve 106 controls the ratio of the amount of cooling fluid which flows into the cylinder head 101*a* to the amount of cooling fluid which flows into the cylinder block 101*b*.

The cooling fluid introduced into the cylinder block 101*b* cools the cylinder block 101*b* and flows toward the cylinder head 101*a*. The cooling fluid introduced into the cylinder head 101*a* cools the cylinder head 101*a*. The warmed cooling fluid which cooled the cylinder head 101*a* and the cylinder block 101*b* is introduced into the outlet conduit 102 and flows into the radiator 103. The warmed cooling fluid is cooled in the radiator 103 by exchanging the heat thereof with cooling air and then flows in the first inlet conduit 104 toward the water-pump 109.

The rate of temperature increment and the temperature distribution are different between the cylinder head 101*a* and the cylinder block 101*b*, however, efficient cooling is achieved therein since the cooling fluid is introduced into the cylinder head 101*a* and the cylinder block 101*b* independently.

When the temperature of the cooling fluid is below the predetermined value, for instance, right after the engine 101 is started, the thermostat value 108 opens the radiator-bypass conduit 107 so that the cooling fluid flows in the radiator-bypass conduit 107 and bypass the radiator 103. The flow control valve 106 closes the second inlet conduit 105 so that the cooling fluid flows into only the cylinder head 101*a* and the cooling fluid temperature increases rapidly.

When a passenger's room is required to be warmed, the water-valve 112 opens the heater conduit 110 to introduce the warmed cooling fluid into the heater 111. The warmed cooling fluid exchanges heat with the air which passes through the heater 111. The heat-exchanged cooling fluid flows into the suction side of the water-pump 109.

The operation of the water-pump 109 is now described. The discharge volume of the water-pump 109 is controlled in three modes, that is, mode I, mode II and mode III. In the mode I, when the number Ne of engine rotations is above N1 (approximately 800 rpm), the discharge volume Vp of the water-pump 109 is constant within the range from 2 l,/min to 15 l/min. In the mode II, when the number Ne of engine rotations is above N2 (approximately 1500 rpm), the discharge volume Vp of the water-pump 109 is constant within the range from 40 l/min to 60 l/min. In the mode III, when the number Ne is above N3 (approximately 2000 rpm), the discharge volume Vp is constant within the range from 100 l/min to 150 l/min.

The discharge volume Vp of the water-pump 109 is determined whether in the mode I, the mode II or the mode III independently from the engine rotation.

Figure 5:
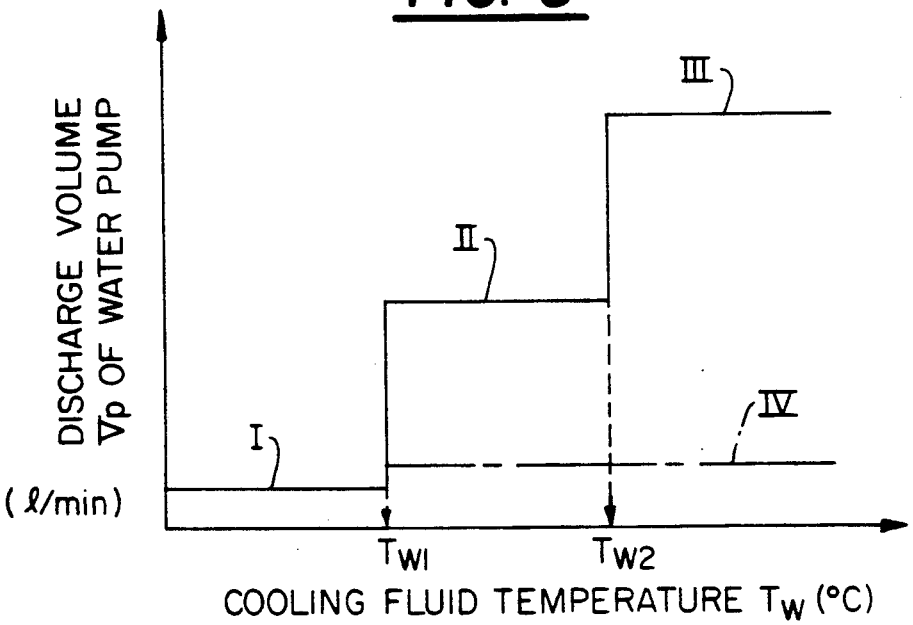
FIG. 5 is a diagram showing a relation between temperature of cooling fluid and a discharge volume of water-pump.

As shown in FIG. 5, when the cooling fluid temperature Tw is below Tw1 (60° C.-80° C.), the waterpump 109 is in the mode I. When the temperature Tw is below Tw2 (80° C.-90° C.) the water-pump 109 is in the mode II. When the temperature Tw is above Tw2, the water-pump 109 is in the mode III. When the engine 101 is idling, the water-pump 109 is in the mode IV wherein the discharge volume Vp is constant when the temperature Tw is above Tw1.

Figure 6:
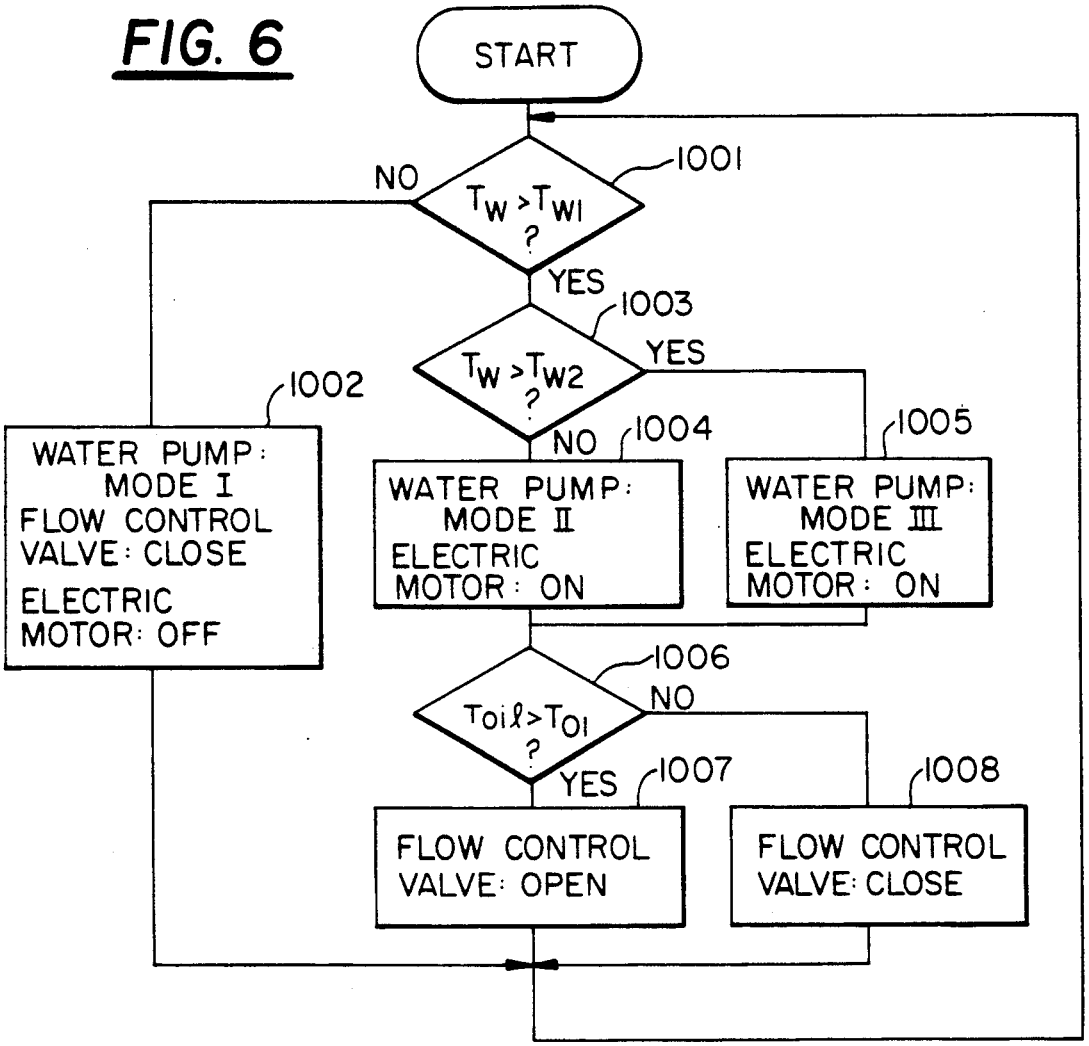
FIG. 6 is a flow chart of an embodiment of the present invention.
Figure 10:
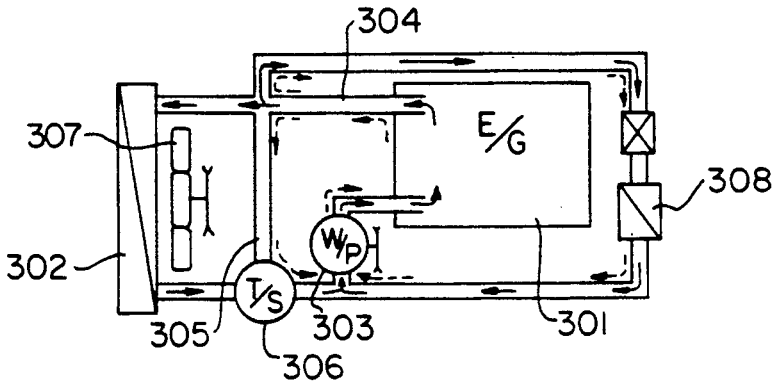
FIG. 10 is a schematic view of a conventional cooling system.

The operation of the ECU 200 is now described in FIG. 6. The program shown in FIG. 6 is carried after the engine 101 is started. At step 1001, the cooling fluid temperature Tw detected by the water temperature sensor 113 is compared to Tw1. When the temperature Tw is below Tw1, step 1002 is carried out. At step 1002, the water-pump 109 is operated in the mode I, the flow control valve 106 closes the second inlet conduit 105, the thermostat 108 opens the radiator-bypass conduit 107 and the electric motor 115 is off. The cooling fluid discharged from the water-pump 109 flows through the second end 104*b*. The cylinder head 101*a*, the outlet conduit 102, the radiator-bypass conduit 107 and the water-pump 109. Since the cooling fluid temperature is relatively low, the amount of the circulating cooling fluid is restricted to prevent an over cooling of the engine 101 and to increase the cooling fluid temperature rapidly. Since the cooling fluid flows only through the cylinder head 101, the cylinder head 101*a* which is high in temperature is cooled efficiently and the cylinder blocks 101*b* is warmed up. Therefore, the engine oil temperature increases efficiently and the warming up of the engine 101 is accomplished in a relatively short period of time.

The step 1001 is carried out again in some microseconds. When the temperature Tw is above Tw1, step 1003 is carried out, wherein the temperature Tw is compared to Tw2. When the temperature Tw is below Tw2, the water-pump 109 is operated in the mode II and the electric motor 115 is on so as to rotate the radiator fan 114. Namely, the rate of circulating cooling fluid is increased according to the cooling fluid temperature, so that the cooling fluid temperature is maintained within the range from Tw1 to Tw2. When the temperature Tw is increased up to 60° C.-80° C., the thermostat valve 108 closes the radiator-bypass conduit 107 so that the cooling fluid flows into the radiator 103.

When the temperature Tw is above Tw2, step 1005 is carried out, wherein the water-pump 109 is operated in the mode III. Namely, the rate of circulating cooling fluid is increased.

At step 1006, the oil temperature Toil detected by the oil temperature sensor 116 is compared to T01 (90°-100° C.). When the oil temperature Toil is above TO1, step 1007 is carried out, wherein the flow control valve 106 opens the second inlet conduit 105. When the oil temperature Toil is below T01, step 1008 is carried out, wherein the flow control valve 106 closes the second inlet conduit 105.

The engine oil temperature increases in the same way as the cooling fluid temperature. Since the engine oil lubricates the inside of the engine, the engine oil affect the engine 101 temperature and receives a heat effect from the engine 101. Therefore, detecting the engine oil temperature is significant to control the flow of the cooling fluid.

When the flow control valve 106 opens the second inlet conduit 105, the cooling fluid discharged from the water-pump 109 flows through the first inlet conduit 104, the second inlet conduit 105 and the cylinder block 101*b*. The cooling fluid introduced into the cylinder block 101*b* merges with the cooling fluid introduced into the cylinder head 101*a* and flows out into the outlet conduit 102. The amount of cooling fluid flowing through the second inlet conduit 105 is controlled within the range from 0% to 50% of the discharge volume of the water-pump 109. The range can be from 5% to 50% when considering the temperature of engine.

When the flow control valve 106 closes the second inlet conduit 105 at step 1008, the cooling fluid is only introduced into the cylinder head 101*a*. The engine oil temperature increases rapidly and the warming up of engine is accomplished in a relatively short period of time.

Figure 7:
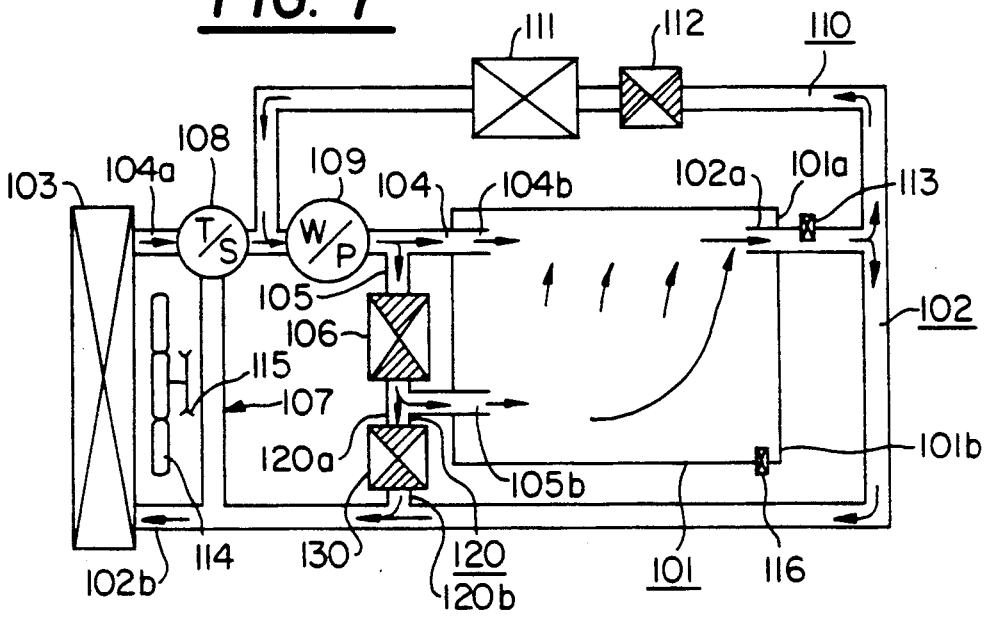
FIG. 7 is a schematic view of a modified embodiment of the present invention.

FIG. 7 shows a modified embodiment wherein a first end 120*a* of an additional conduit 120 is connected to the second inlet conduit 105 and a second end 120*b* of the same is connected to the outlet conduit 102. An additional flow control valve 130 is provided in the additional conduit 120. The same reference numbers as in FIG. 1 are used for identical or similar parts in FIG. 7.

According to the modified embodiment described above, the cooling fluid which does not contribute to cool the engine bypasses the engine 101, and the heat loss which is transferred from the engine 101 to the cooling fluid does not increase. Since the heat exchanging capacity of the radiator 103 is constant, the temperature of the cooling fluid introduced into the engine 101 is decreased when the heat loss is equal to the heat which is radiated by the radiator 103. Therefore, the engine 101 is prevented from over heating and the power of the engine is improved.

Figure 8:
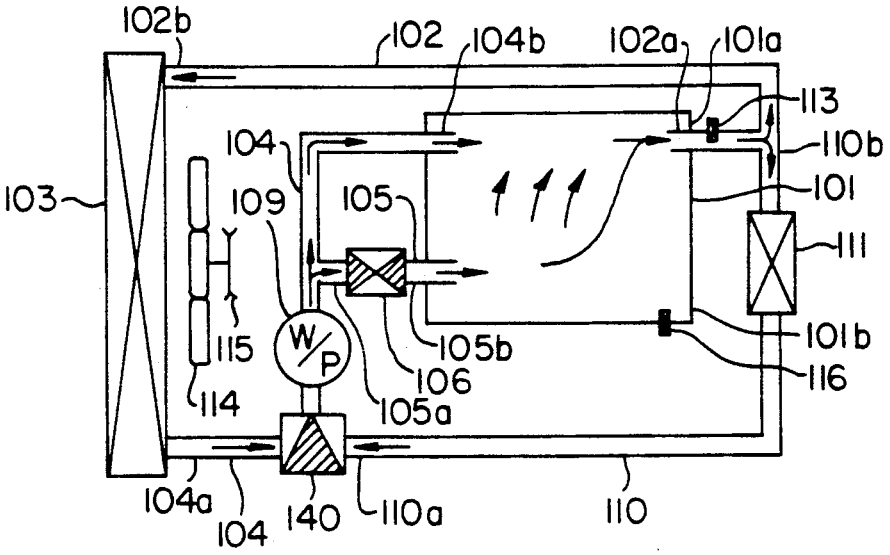
FIG. 8 is a schematic view of another embodiment of the present invention.

FIG. 8 shows another embodiment wherein a variable thermostat valve 140 is disposed, instead of the water-valve 112, at the connecting point of the heater conduit 110 with the first inlet conduit 104 and an outside-air temperature sensor (not shown) is provided. The same reference numbers as in FIG. 1 are used for identical or similar parts in FIG. 8.

Figure 9:
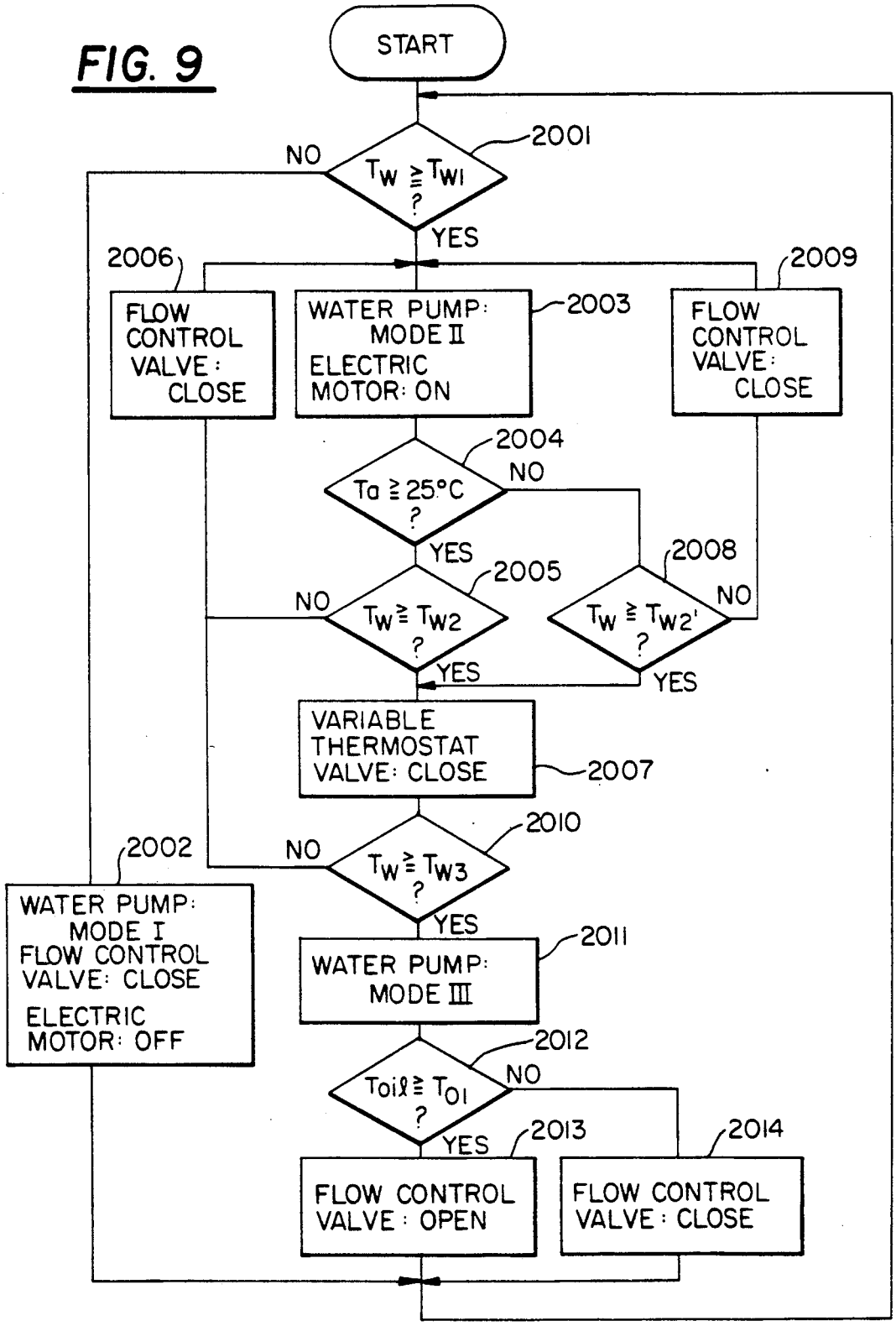
FIG. 9 is a flow chart of another embodiment of the present invention.

The operation of the ECU 200 of the embodiment is now described according to the flow chart shown in FIG. 9.

The cooling fluid temperature Tw is compared to Tw1 (approximately 40°-60° C.) at step 2001. When the cooling fluid temperature Tw is below Tw1, step 2002 is carried out wherein the water-pump is operated in the mode I. The flow control valve 106 closes the second inlet conduit 105 and the electric motor 115 is off. The cooling fluid discharged from the water-pump 109 flows through the first inlet conduit 104, the second end 104*b*, the cylinder head 101*a*, the outlet conduit 102, the radiator 103 and the first end 104*a*. The amount of cooling fluid is restricted to prevent an over cooling of the engine 101 and to increase the temperature thereof rapidly. The variable thermostat valve 140 opens the heat conduit 110 so that the cooling fluid flowed out from the engine 101 flows into the outlet conduit 102 and the heater conduit 110 to bypass the radiator 103.

When the cooling fluid temperature Tw is above Tw1, step 2003 is carried out, wherein the water-pump 10 is operated in the mode II and the electric motor 115 is on to rotate the radiator fan 114. The amount of cooling fluid is increased, according to the temperature thereof, to maintain the temperature within the range from Tw1 to Tw2.

At step 2004, the outside-air temperature Ta is compared to 25° C. When the outside-air temperature Ta is above 25° C., for instance in summer, step 2005 is carried out, wherein the cooling fluid temperature Tw is compared to Tw2 (approximately 60° C.). When the cooling fluid temperature Tw is below Tw2, the flow control valve 106 closes the second inlet conduit 105 and the step 2003 is carried out. The flow control valve 106 closes the second inlet conduit 105 when the cooling fluid is at a low temperature in summer-type conditions (Ta is above 25° C.).

When the cooling fluid temperature Tw is above Tw2, the variable thermostat valve 140 closes the heater conduit 110 at step 2007. When the outside-air temperature Ta is below 25° C., for instance in winter, step 2008 is carried out, wherein the cooling fluid temperature Tw is compared to Tw2' (approximately 90° C.). When the cooling fluid temperature Tw is below Tw2', the flow control valve 106 closes the second inlet conduit 105 at step 2009.

When the variable thermostat 140 closes the heater conduit 110 at step 2007, all of the cooling fluid flows into the radiator 103 through the outlet conduit 102. When the passenger's room is required to be warmed, the variable thermostat 140 opens the heater conduit 110 in a certain amount to introduce the warmed cooling fluid into the heater 111.

When the cooling fluid temperature Tw is below Tw3 (approximately 100° C.) at step 2010, step 2006 carried out.

When the cooling fluid temperature Tw is above Tw3, the water-pump 109 is operated in the mode III at step 2011 to increase the amount of circulating cooling fluid.

When the oil temperature Toil is above TO1 (approximately 90°-100° C.), the flow control valve 106 opens the second inlet conduit 105, so that the cooling fluid is introduced into both the cylinder head 101*a* and the cylinder block 101*b*. The amount of cooling fluid flowing through the second inlet conduit 105 is controlled within the range from 0% to 50% of the discharge volume of the water-pump 109.

When the oil temperature Toil is below TO1, step 2014 is carried out, wherein the flow control valve 106 closes the second inlet conduit 105 so that the cooling fluid only flows into the cylinder head 101*a*.

According to the present embodiment, the heater conduit 110 is also used as the radiator-bypass conduit, and an effective cooling is thereby achieved.

What is claimed is:

1. A method of cooling an internal-combustion engine, comprising the steps of:

detecting a temperature of a cooling fluid for an internal-combustion engine, the cooling fluid being for cooling a cylinder head and a cylinder block of the internal-combustion engine;

controlling a rate of the cooling fluid independently of the internal-combustion engine when the temperature of the cooling fluid is above a predetermined value;

detecting a temperature of an engine oil which lubricates the internal-combustion engine; and dividing a stream of the cooling fluid into two streams, one of the streams is introduced into the cylinder head and the other of the streams is introduced into the cylinder block when the temperature of engine oil is above the predetermined value.

2. A cooling device for an internal-combustion engine, comprising:

a head exchanger for absorbing heat from a cooling fluid;

an outlet conduit introducing the cooling fluid from the internal-combustion engine into the heat-exchanger;

a first inlet conduit for introducing the cooling fluid into a cylinder head of the internal-combustion engine;

a second inlet conduit for introducing the cooling fluid into a cylinder block of the internal-combustion engine;

a flow control means for controlling a rate of cooling fluid flowing through the second inlet conduit;

a circulating means for circulating the cooling fluid;

a first temperature detecting means for detecting the temperature of the cooling fluid;

a second temperature detecting means for detecting the temperature of an engine oil in the internal-combustion engine; and a control means for increasing the rate of circulating cooling fluid and opening the second inlet conduit when the temperature of the engine oil is above a predetermined value.

3. A cooling device for an internal-combustion engine as recited in claim 2, further comprising:

an additional conduit which connects the second inlet conduit with the outlet conduit to bypass the heat-exchanger.

4. A cooling device for an internal-combustion engine as recited in claim 2, wherein the control means increases the rate of circulating cooling fluid according to a rotational speed of the internal-combustion engine and the temperature of the cooling fluid.

* * * * *